US012593909B2

(12) United States Patent
Massey

(10) Patent No.: US 12,593,909 B2
(45) Date of Patent: Apr. 7, 2026

(54) TAPE ROLL HOLDER FOR SKILLED CRAFTSMEN

(71) Applicant: Zackery Massey, Kokomo, IN (US)

(72) Inventor: Zackery Massey, Kokomo, IN (US)

( * ) Notice: Subject to any disclaimer, the term of this patent is extended or adjusted under 35 U.S.C. 154(b) by 105 days.

(21) Appl. No.: 18/401,594

(22) Filed: Dec. 31, 2023

(65) Prior Publication Data

US 2025/0213024 A1 Jul. 3, 2025

(51) Int. Cl.
*A45F 5/02* (2006.01)
*A45F 5/00* (2006.01)

(52) U.S. Cl.
CPC ..... *A45F 5/021* (2013.01); *A45F 2005/002* (2013.01)

(58) Field of Classification Search
CPC ..... A45F 5/1575; A45F 2005/006; A45F 2005/025; B65H 2701/377; B65H 2402/413
See application file for complete search history.

(56) References Cited

U.S. PATENT DOCUMENTS 635,121 A * 10/1899 Bostrom ..... A47G 25/746 24/550
2,082,301 A * 6/1937 Pearson ..... A47H 1/18 211/105.5
4,741,492 A * 5/1988 Reysen ..... A45F 5/102 242/129
6,070,106 A * 5/2000 Hall ..... G05G 11/00 700/95
6,530,131 B1 * 3/2003 Hopkins ..... A45F 5/00 24/301
2007/0205235 A1 * 9/2007 Knight ..... B25H 3/00 224/681
2010/0122709 A1 * 5/2010 Janatpour ..... A45F 5/00 132/286
2011/0035921 A1 * 2/2011 Spooner ..... A45F 5/02 224/271
2012/0074186 A1 * 3/2012 Hung ..... A45F 3/14 224/254
2013/0146624 A1 * 6/2013 Soria ..... B65H 16/005 224/162
2018/0140080 A1 * 5/2018 Fogle ..... A45F 5/022

* cited by examiner

*Primary Examiner* — Adam J Waggenspack
(74) *Attorney, Agent, or Firm* — Robert S. Smith

(57) ABSTRACT

A connection apparatus dimensioned and configured for engagement with products worn by a craftsman including an elongated member depending from the connection apparatus, and having first and second axial extremities. the first axial extremity being fixed to the connection apparatus transverse member. An elongated transverse member is coupled to the second axial extremity, the transverse member has the characteristic that it will not deflect laterally with elastic deformation to the force caused by supporting a roll of tape and will deflect with elastic deformation in response to a force greater than the force caused by supporting a roll of tape.

5 Claims, 3 Drawing Sheets

TAPE ROLL HOLDER FOR SKILLED CRAFTSMEN

TECHNICAL FIELD

The present invention is generally directed to tools and related equipment commonly used by skilled craftsmen including electricians, plumbers, and builders. More particularly, the present invention is directed to apparatus for holding a roll of tape. Even more particularly, the present invention is directed to a holder for a roll of tape that facilitates the user being able with only a single hand to (a) access a roll of tape for use as well as (b) return the roll of tape to a stored position.

BACKGROUND OF THE INVENTION

The prior art includes various tool belts. All such belts are intended to hold the most frequently used tools so that they will be conveniently and rapidly available. One application for the present invention is as an accessory mounted on a tool belt or other tool holding apparatus.

The prior art includes tape holders, for example, that provide a chain having a T-shaped extremity for engaging a roll of tape. The user typically mounts a roll of tape on such apparatus by holding a roll of tape in one hand and grasping the T-shaped extremely with the other hand. While this arrangement is useful, the user may be positioned on a ladder requiring a hand to stabilize his position as well as using at least one hand to hold a workpiece on which tape is to be secured. Accordingly, the need for two hands to access the tape as well as to apply the tape before storing a roll of tape again can present repetitive problems for the craftsman.

From the above, it is therefore seen that there exists a need in the art to overcome the deficiencies and limitations described herein and above.

SUMMARY OF THE INVENTION

The shortcomings of the prior art are overcome and additional advantages are provided through a connection apparatus dimensioned and configured for engagement with products worn by a craftsman including an elongated member depending from the connection apparatus, and having first and second axial extremities. the first axial extremity being fixed to the connection apparatus transverse member. An elongated transverse member is coupled to the second axial extremity, the transverse member has the characteristic that it will not deflect laterally with elastic deformation to the force caused by supporting a roll of tape and will deflect with elastic deformation in response to a force greater than the force caused by supporting a roll of tape.

The elongated transverse member in some embodiments is an elongated expansion coil spring having a geometric axis perpendicular to the elongated member. The connection apparatus may include a clasp dimensioned and configured for engagement with a tool belt as well as a swivel connection. The elongated member may be a multistrand stainless steel cable and the elongated transverse member may be an expansion coil spring.

Because of the difficulty of using the prior art apparatus, it is an object of the present invention to provide apparatus that will enable a user, using only one hand, to access a roll of tape as well as, using only one hand, return a roll of tape to the previously stored position.

It is another object of the present invention to provide an apparatus that is simple and inexpensive to manufacture.

Additional features and advantages are realized through the techniques of the present invention. Other embodiments and aspects of the invention are described in detail herein and are considered a part of the claimed invention.

The recitation herein of desirable objects that are met by various embodiments of the present invention is not meant to imply or suggest that any or all of these objects are present as essential features, either individually or collectively, in the most general embodiment of the present invention or any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
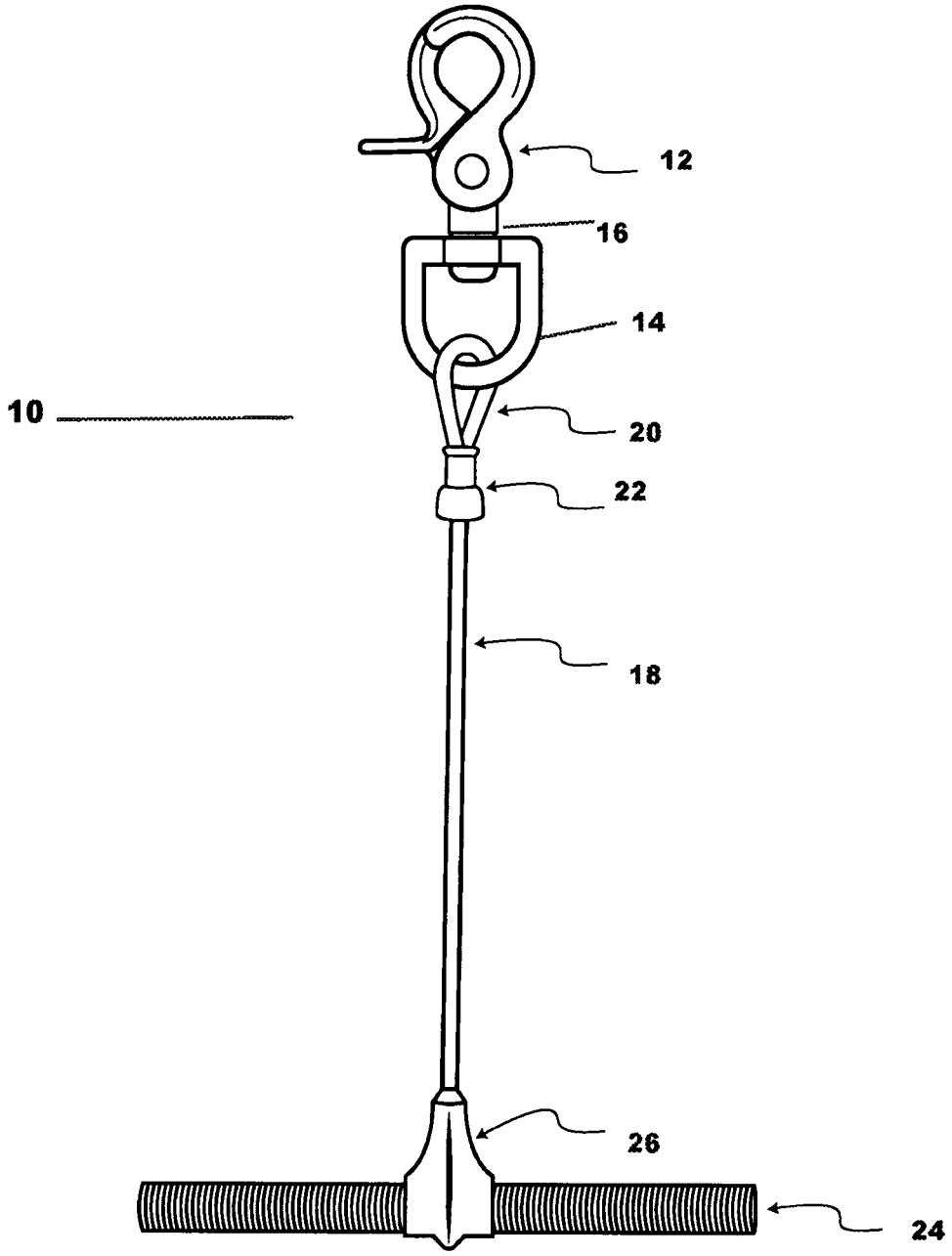
FIG. 1 is a side view of one embodiment of the present invention.

The present invention provides the user the ability to access a roll of tape from a storage position, as well as return the roll of tape to the stored position and in each case using only a single hand.

Referring now to the drawing there is shown a preferred embodiment of the present invention suitable to be an attachment to a workman's tool belt. It will be described as being understood that the illustrated embodiment of the present invention is particularly adapted for mounting on a tool belt of the user. With or without variations in the illustrated preferred embodiment the present invention may be attached to, for example, a tool pouch, a tool bag, a backpack, a tool carrying tray, or a tool carrying pail.

Disposed at the top of the illustrator preferred embodiment 10 is a ½ inch lobster claw clasp 12. A lobster clasp, also known as a lobster hook, lobster claw, trigger clasp, or bocklebee clasp, is a fastener that is held closed by a spring. The lobster clasp is opened or closed by holding a small lever, usually with a fingernail, long enough to apply, then it is attached (or removed from) a given device. The illustrated lobster clasp 12 includes a D ring 14 having a swivel connection 16.

Extending from the D ring 14 is stainless steel cable 18 which is a $1/16^{th}$ inch 7*7 strand core. In simple terms; 7×7 means 7 stands of wire twisted to form 1 strand, which is then combined with 6 more of these; 49 stands in total (i.e., 7×7=49). The stainless-steel cable 18 provides both the desired flexibility.

The upper axial extremity of the cable 18 loops around the D ring 14. More particularly, the portion of the cable 18 surrounding the D ring is supported by a thimble. The reference numeral 20 identifies both that portion of the cable and the thimble. The cable thimble is used to reinforce a loop of cable 18 to prevent fraying. Thereafter, the loop is secured by a crimped cable sleeve 22.

The lower extremity of the cable 18 is looped around the midsection of an extension spring 24 and a crimped sleeve 26 secures the free end. Thereafter, the connection is dipped in a Plasti Dip® coating manufactured by Plasti Dip International Inc. Blaine, MN 55449. After the dipping process, the outer surface is carved into the shape illustrated.

Figure 2:
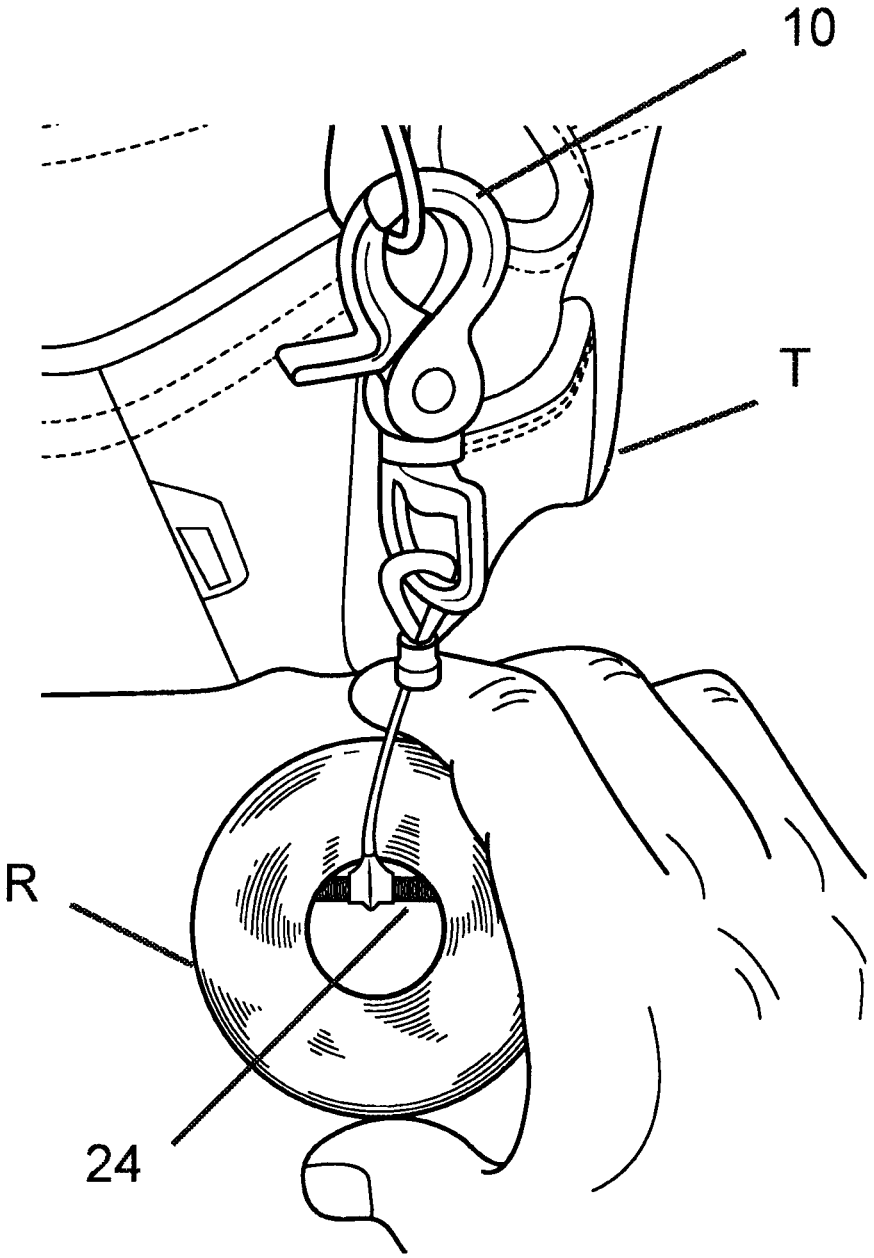
FIG. 2 is an isometric view of one embodiment of the tool engaged with a tool belt holding an associated roll of tape. More particularly the drawing illustrates the ease with which a user can easily detach the roll of tape from the tool with a small tug. For description purposes, only a single roll of tape is shown and described. Typically, the user will carry multiple rolls of tape supported by the present apparatus.

FIG. 2 is an isometric view of an embodiment of the tool 10 engaged with tool belt T holding an associated roll of tape R. More particularly the drawing illustrates the ease with which a user can easily detach the roll of tape from the tool. The user merely needs to grasp the roll of tape R and pull it over the spring 24.

Figure 3:
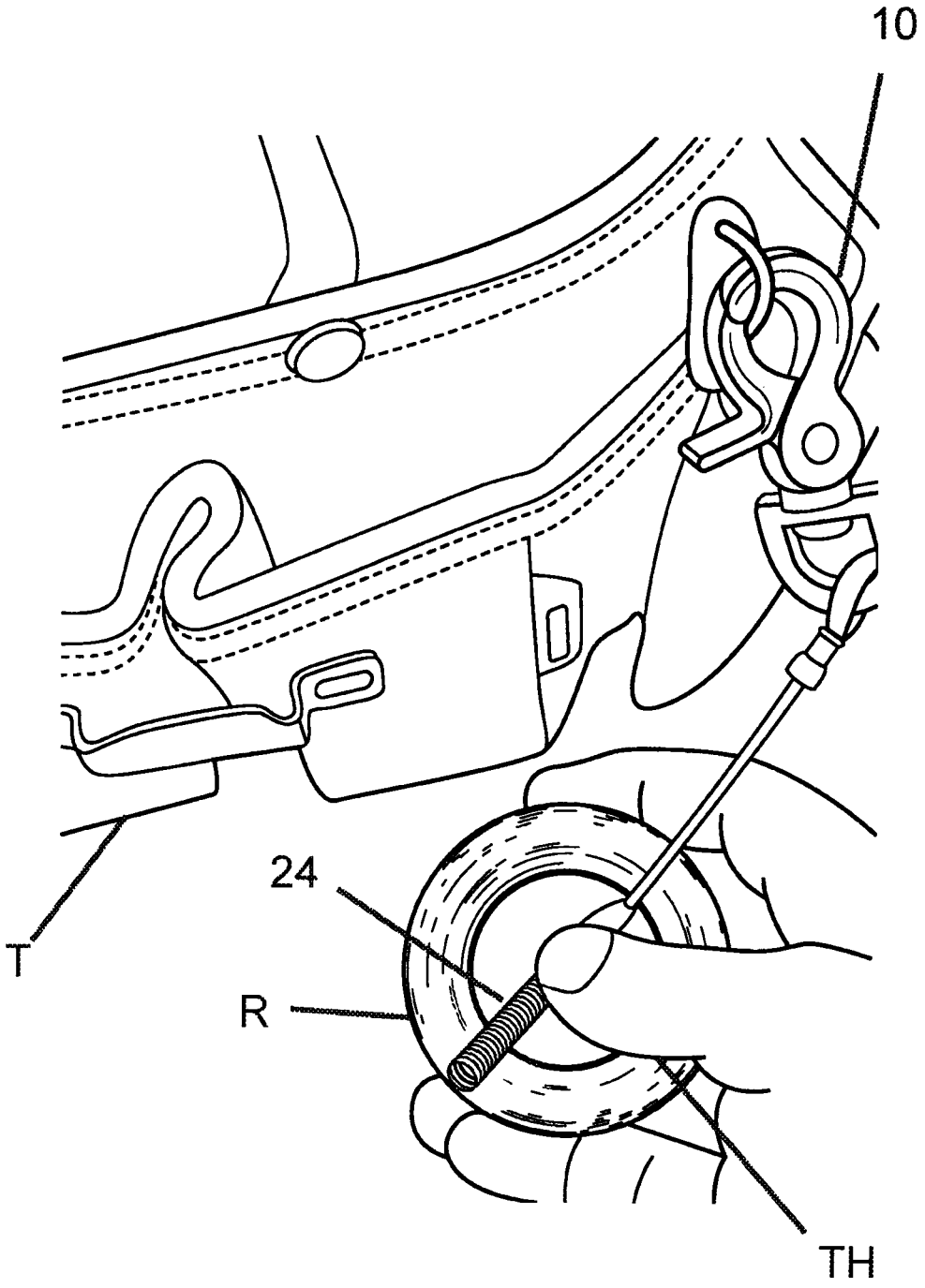
FIG. 3 is an isometric view illustrating a user mounting a roll of tape on the tool. The user has hooked one end of the spring through the hole in the roll of tape and has positioned his thumb to quickly engage the transverse spring part in the manner shown in the drawing whereby the roll is secured in the manner shown in FIG. 2.

FIG. 3 is an isometric view illustrating a user mounting a roll of tape on the tool. The user has hooked one end of the spring 24 through the hole in the roll of tape R and has positioned his thumb TH to quickly push the rest of the spring 24 through the center hole of the roll of tape R whereby the roll R will be supported by the tool 10 in exactly the manner shown in FIG. 2. All publications and patent applications mentioned in this specification are indicative of the level of skill of those skilled in the art to which this invention pertains. All publications and patent applications are herein incorporated by reference to the same extent as if each publication or patent application was specifically and individually indicated to be incorporated by reference.

Although the description above contains many specifics, these should not be construed as limiting the scope of the invention, but as merely providing illustrations of some of the presently preferred embodiments of this invention.

Still, further illustrations of presently preferred embodiments include alternatives to the lobster claw clasp 12. It will be understood that various other embodiments may alternatively incorporate other attachment apparatus such as various clips, clamps, snaps, fasteners, hooks, clasps, and rivets.

Similarly, the description of the present invention describes a coiled extension spring to provide a member that is rigid enough to support a roll of tape and flexible enough to allow the entire axial extent of the member to bend sufficiently to allow easy penetration of the center hole in a roll of tape.

Alternatives to the illustrated expansion coil spring cylindrical spring that meet the above rigidity and flexibility requirements include, for example, a 180° torsion spring having coplanar legs extending in opposite directions, as well as certain plastic, rubber or metallic materials having the requisite elastic deformation characteristics. Other embodiments will include, for example, a single steel wire heat-treated to provide the requisite elastic deformation characteristics of the complex the same object. Similarly, various leaf springs meeting the required characteristics would also be satisfactory.

Alternatives to the stainless steel multistrand cable include a chain, rope, string, or wire.

Thus, the scope of this invention should be determined by the appended claims and their legal equivalents. Therefore, it will be appreciated that the scope of the present invention fully encompasses other embodiments which may become obvious to those skilled in the art and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. Apparatus which comprises:

a connection apparatus dimensioned and configured for engagement with products worn by a craftsman selected from the group consisting of clothing and tool belts;

an elongated first member depending from said connection apparatus, said elongated first member having first and second axial extremities, said first axial extremity being fixed to said connection apparatus, an elongated transverse member coupled to said second axial extremity of said first member, said transverse member not deflecting laterally with elastic deformation to the force caused by supporting a roll of tape and does deflect downward with elastic deformation in response to a force greater than the force caused by supporting a roll of tape, said tranverse member deflecting upward in response to a force greater than the force required to support a roll of tape;

said elongated transverse member is an elongated expansion coil spring having a geometric axis perpendicular to said elongated member.

2. The apparatus as described in claim 1 wherein said elongated member is a multistrand stainless steel cable looped around the axial midsection of said expansion coil spring.

3. The apparatus as described in claim 2 further including a plastic coating over said stainless steel cable looped around the axial midsection of said expansion coil spring.

4. The apparatus as described in claim 3 wherein said elongated transverse means is an elongated expansion coil spring having a geometric axis perpendicular to said elongated member.

5. The apparatus as described in claim 4 wherein said means for suspending is a multistrand stainless steel cable.

* * * * *